United States Patent [19]

Kesten

[11] Patent Number: 4,772,337

[45] Date of Patent: Sep. 20, 1988

[54] COMPRESS GAS CONTAINER OF AUSTENITE STEEL ALLOY

[75] Inventor: Martin Kesten, Rosrath, Fed. Rep. of Germany

[73] Assignee: Messer Griesheim GmbH, Fed. Rep. of Germany

[21] Appl. No.: 37,018

[22] Filed: Apr. 10, 1987

[30] Foreign Application Priority Data

Apr. 26, 1986 [DE] Fed. Rep. of Germany ..... 3614290

[51] Int. Cl.[4] ..... C21D 9/00

[52] U.S. Cl. ..... 148/12 E; 148/125; 148/327; 204/129.1

[58] Field of Search ..... 148/12 E, 327, 125; 206/0.6; 204/212, 129.1

[56] References Cited

U.S. PATENT DOCUMENTS

| | | | |
|---|---|---|---|
| 3,255,051 | 6/1966 | Gilbert | 148/125 |
| 3,258,370 | 6/1966 | Floreen | 148/12 E |
| 3,919,061 | 6/1975 | Jumer | 204/212 |

FOREIGN PATENT DOCUMENTS

| | | | |
|---|---|---|---|
| 622713 | 5/1949 | United Kingdom | 148/327 |

OTHER PUBLICATIONS

Yushin, A. S., et al., "Container for Volatile Inorganic Hydrides of Specially High Purity", Instrum. & Exp. Tech., vol. 22, No. 1, p. 2 (Jan–Feb 1979) (Publ. Aug. 1979).

*Primary Examiner*—Wayland Stallard
*Attorney, Agent, or Firm*—Connolly & Hutz

[57] ABSTRACT

A compress gas container is made from Austenite steel alloy and is later strengthened or stabilized by cryo-deformation. The Austenite steel alloy is a metastable CrNi steel with a combined titanium and niobium content no greater than 0.02% by weight and a carbon content no greater than 0.045% by weight. With the nickel content up to 9.5% by weight, the carbon content is between 0.03% to 0.045%; and with the nickel content between 9.5% and 10%, the carbon content is below 0.03%.

4 Claims, 1 Drawing Sheet

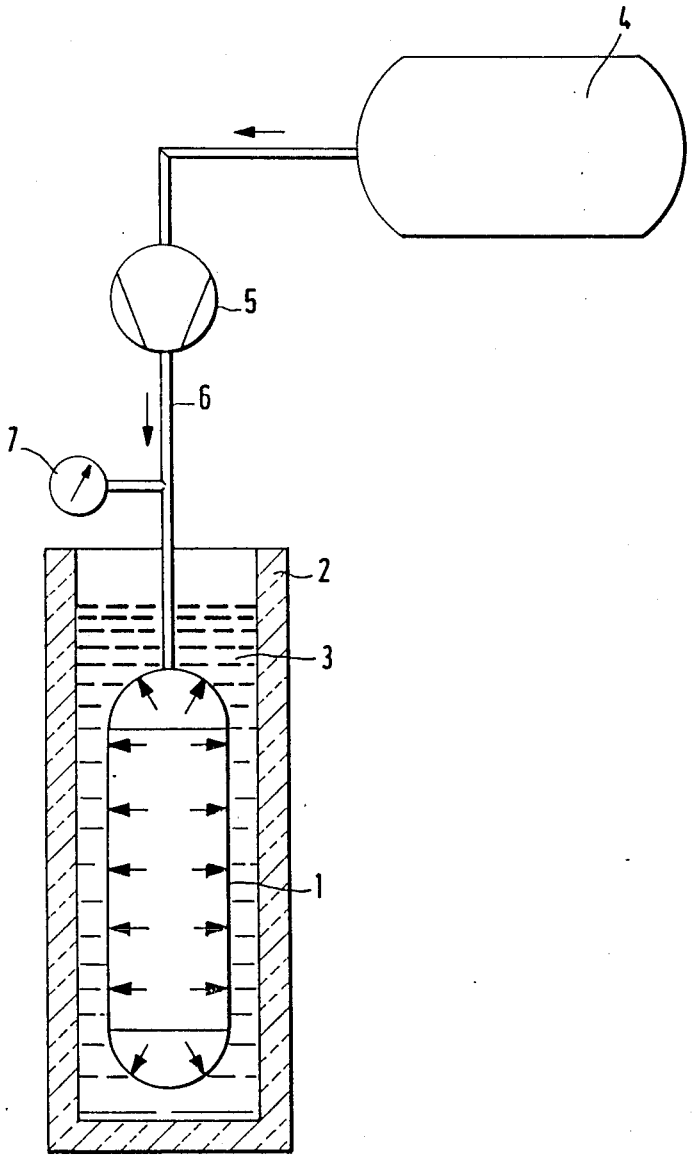
4
5
6
7
2
3
1

COMPRESS GAS CONTAINER OF AUSTENITE STEEL ALLOY

BACKGROUND OF INVENTION

The invention involves a compress gas container constructed of an Austenite steel alloy which is provided in particular for storage and distribution of gases. Those installations and devices employed for storage and distribution of ultra-pure gases, which e.g. are being used increasingly in the semi-conductor industry, are required to fulfill ever more specialized requirements. Thus, only those materials may be used, the surfaces of which can be pre-treated so that the pure chemical composition of the gases which come into contact with them will not change. Especially, there must be no emission of surface particles such as would contaminate the gases in an inadmissible manner.

These prerequisites can no longer be met by the traditional ferritic constructional materials. Therefore, all the component parts presently used for storing and distributing ultra-pure gases are manufactured of Austenite CrNi steels, and their surfaces in contact with the gases are "polished" electrolytically. By electrolytic polishing, the surface layer that has been contaminated and covered by the manufacturing and finishing processes especially, is eliminated. In addition, the surface roughnesses are smoothed out, and thus the surface area lessened which effectively comes in contact with the medium.

Whereas this technology is already in widespread use in the case of containers for transporting and storing supercooled liquid gases, still there exist formidable, as yet unsolved difficulties in the matter of transferring these methods to compress gas containers for compressed ultra-pure gases.

The chief obstacle is presented by the extraordinarily low mechanical ductility of the Austenite steels. Compared to the usual ferritic pressure container materials, Austenite CrNi steels, if made of use in the ordinary commercial fashion, will exhibit characteristic values for toughness that are diminished by a factor of from 3 to 4. In the case of containers of equal capacity, this would signify a correspondingly larger outlay of building material and a correspondingly heavier weight. The result would be that the storage space, as related to the overall weight, of such traditionally-used Austenite compress gas containers would reduce to insignificance. Therefore, their use in the transporting of gas, e.g. as compress gas flasks, is arguably economical only in exceptional cases.

SUMMARY OF INVENTION

An object of this invention is to provide a compress gas container for storing ultra-pure gases which, on the one hand, would make possible the use of the prerequisite CrNi steels as container material for the reasons given of conserving the purity of the gas, and which would, on the other hand, increase the storage capacity of the container with respect to the overall weight such that it would approximate that of pressure containers which are constructed of the usual ferritic materials.

In accordance with this invention the Austenite steel alloy is a metastable CrNi steel with a combined titanium a niobium content of no greater than 0.2% by weight and a carbon content no greater than 0.045% when the nickel content is up to 9.5%, the carbon content is between 0.03% to 0.045%. When the nickel content is between 9.5% and 10%, the carbon content is below 0.03%.

The cryo-forming of Austenite building materials, including for the production of pressure containers, is sufficiently known as, for example, from DE-OS No. 14 52 533 and DE-PS No. 26 54 702. Suitable container materials for realizing the invention are, to cite a few, the metastable steel qualities 1.4301, 1.4306, and 1.4404, according to DIN 17 440, which, however, deviate from the norm in their analysis tolerances. A basic prerequisite for carrying out of the stabilizing, with simultaneous fulfillment of the purity prerequisite and of the surface treatment associated with it, is, namely, that the materials employed must contain no titanium and niobium (Ti+Nb under 0.02% by weight). In addition, the carbon and nickel content must be kept down in the manner indicated.

In order to bring the compress gas containers up to the desired high level of ductility, the preformed containers are shaped by increasing the internal pressure by a definite amount at lower temperatures. The temperature must lie below the martensite formation temperature Md. This is that temperature, above which no martensite transformation may take place, independent of the size of the mechanical deformation. Under these conditions, the material stabilizing markedly, more so than is the case with normal cold forming, because of the fact that the texture is transformed partially into martensite. The degree of stabilization thus corresponds to the amount of structural transformation.

Because of the fact that the structural part which becomes transformed into martensite will increase when the forming temperature drops and the degree of forming rises, therefore the most favorable stabilizing conditions for the containers are met when the shaping process is carried out at a temperature which is perceptibly below Md. The most expedient thing is for the forming to take place below the Ms temperature. This is the temperature at which the structural transforming into martensite is realized in the absence of a simultaneous deformation. In such a case, it is a question of only a relatively slight deformation that is necessary, for example, a degree of forming of below 12%, in order to convert a sufficiently large portion of structure, and thus to achieve the desired high degree of ductility.

The MS temperature of the suitable mestastable C-Ni steel-types, given the correct proportions of carbon and nickel in accordance with the invention, may be calculated by the known formulas of Eichelmann and Hull, and lie close to the temperature of liquid nitrogen. Thus the shaping of the preformed containers will take place most efficiently after they have been pre-cooled by being filled with or dipped in liquid nitrogen. Either liquid nitrogen itself can be used as the medium in order to create the internal pressure which is required for the forming, or a gas, e.g. helium, which does not condense at this temperature. The intensity of the pressure to be applied is determined by the geometry of containers, and in accordance with the material strength which is desired.

THE DRAWINGS

The single FIGURE illustrates a device for carrying out the process of this invention.

DETAILED DESCRIPTION

The preformed container 1 is placed in an insulated cryo-container 2, which is filled with liquid nitrogen 3. Gaseous helium is drawn off from a provisional container 4, and then subjected to the desired forming pressure by means of the compressor 5; and then introduced into the interior of the preformed container through the conduit 6. The forming pressure is regulated by means of the pressure gauge 7.

In the case of cylindrical containers with hemispherical bottoms, the highest stress during the dimensioning of the container under extreme internal pressure occurs within the cylindrical space.

$$\text{circumference} = \frac{Dm\ P}{20\ s}\ (\text{MPa})$$

Dm: average cylindrical diameter (mm)

p: internal pressure (bar)

s: cylindrical-wall thickness (mm)

The tension produced during cryo-forming, according to this formula corresponds to the desired material strength $R_p$ (Cryo) (Extension limit at deformation temperature). As experiments have shown with identically manufactured containers, this is accordingly to be equated with the tensile strength of the material at ambient temperature $R_{m(RT)}$, since it has been proven that the rupture limit of containers which are manufactured by cryo-forming coincides fairly well with the pressure that is applied during cryo-stabilizing. With the knowledge of these interrelationships, it is possible to estimate the containers to be produced in accordance with their own peculiar operational requirements, and thus to strengthen them in the manner which has been described.

The following table contains, as an example, the characteristic data of experimental containers which have been produced, in accordance with the invention, from a cylindrical tube and two soldered-on hemispherical bottoms made of modified material 1.4301, and, by way of comparison, the corresponding values of a container manufactured according to the traditional procedure.

| Volume (Liter) | Initial Mass (mm) | Forming Pressure (bar) | Final Mass (mm) | $R_p$(cryo) Pressure (MPa) | Bursting Pressure (bar) | Operating (bar) | Weight Pressure (Kg) |
|---|---|---|---|---|---|---|---|
| Invention | | | | | | | |
| 3 | 93 × 2 | 400 | 101 × 1.8 | 1100 | 392 | 150 | 2 |
| 10 | 133 × 4 | 550 | 146 × 3.6 | 1115 | 560 | 200 | 10.5 |
| Traditional | | | | | | | |
| 10 | 142 × 10.3 | | 142 × 103 | | 7500 | 200 | 40 |

As demonstrated at the beginning, it is absolutely requisite to polish electrolytically the internal surfaces of the compress gas containers. This process may be carried out either before or after the cryo-forming. In order to obtain the optimum result in polishing, however, this process is more expediently to be executed with a virgin container that has not yet been cryo-formed. While in this condition, the material of the container still possesses a homogenous, Austenite structure, the polishable surfaces of which have not been impaired by the coexistence of Austenite and martensite structural components.

This surface condition will moreover remain throughout the subsequent shaping process unchanged in all essentials, because, as has been described, the deformation of the virgin container takes place at low temperature, such that, in spite of a high rise in strength, the total deformation of the container material, and thus that also of the electrolytically polished surface, will remain slight.

SUMMARY

The surface of containers, in which ultra-pure gases are to be stored, must, with reference in the purity and inertness which they must maintain against their medium, meet extremely demanding standards. This thus requires the employment of CrNi steels, to be used as the material of the containers. However, since these materials possess only a very low ductility, therefore all compress gas containers that are manufactured in accordance with traditional procedures, and of CrNi steels, are, because of the large expenditure on material, very expensive, and heavy, so that their employment as transporting containers is prohibitive in most cases.

In order to manufacture lightweight containers that are adapted and suitable for the storage of ultra-pure gases, metastable CrNi steel, with defined amounts of titanium, niobium, nickel, and carbon, is used as the material for the containers. The virgin containers, after an optimum pre-treatment of electrolytic polishing, are then plastically deformed and consequently strenghtened, or stabilized, by applying an internal pressure, at temperatures below the martensite transformation temperature, in a manner that is self-evident.

I claim:

1. In a compress gas container manufactured from an Austenite steel alloy wherein the virgin container is subsequently strenghtened or solidified by cryo-deformation, the improvement being in that the Austenite steel alloy is a metastable CrNi steel, with a combined titanium and niobium content which is equal to or smaller than 0.02% by weight, and a carbon content which is equal to or smaller than 0.045% by the weight, the carbon content being between 0.03% and 0.045% by weight when the nickel content is up to 9.5% by weight, the carbon content being below 0.03% by weight when the nickel content is between 9.5% and 10% by weight.

2. Compress gas container, according to claim 1, characterized by the fact that the virgin container is polished electrolytically prior to cryo-deformation.

3. In a process for manufacturing a compress gas container made from Austenite steel alloy wherein the virgin container is subsequently strengthened or stabilized by cryo-deformation, the improvement being using as the Austenite steel alloy a metastabile CrNi steel having a combined titanium and niobium content no greater than 0.02% by weight and a carbon content no greater than 0.045% by weight, using a carbon content between 0.03% and 0.045% by weight when the nickel content is up to 9.5% by weight, and using a carbon content less than 0.03% by weight when the nickel content is between 9.5% and 10% by weight.

4. The process according to claim 3, characterized by the virgin container being polished electrolytically prior to cryo-deformation.

* * * * *